US007467508B2

(12) United States Patent
Fink et al.

(10) Patent No.: US 7,467,508 B2
(45) Date of Patent: Dec. 23, 2008

(54) TWO-FOR-ONE TWISTING SPINDLE COMPRISING A PNEUMATICALLY ACTUATED THREADING DEVICE

(75) Inventors: Heinz Fink, Krefeld (DE); Ludwig Appelhans, Krefeld (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 11/663,908

(22) PCT Filed: Aug. 6, 2005

(86) PCT No.: PCT/EP2005/008548

§ 371 (c)(1),
(2), (4) Date: Mar. 27, 2007

(87) PCT Pub. No.: WO2006/042578

PCT Pub. Date: Apr. 27, 2006

(65) Prior Publication Data

US 2008/0047250 A1 Feb. 28, 2008

(30) Foreign Application Priority Data

Oct. 14, 2004 (DE) ..... 10 2004 050 180

(51) Int. Cl.
*D01H 1/10* (2006.01)

(52) U.S. Cl. ..... 57/58.7; 57/58.83

(58) Field of Classification Search ..... 57/58.49, 57/58.7, 58.83

See application file for complete search history.

(56) References Cited

U.S. PATENT DOCUMENTS

| | | | | |
|---|---|---|---|---|
| 4,168,605 | A * | 9/1979 | D'Agnolo | 57/279 |
| 4,453,377 | A * | 6/1984 | Inger et al. | 57/279 |
| 4,542,618 | A * | 9/1985 | Lossa | 57/58.83 |
| 4,569,189 | A * | 2/1986 | Frentzel-Beyme | 57/58.83 |
| 5,347,805 | A | 9/1994 | Butzke et al. | 57/279 |
| 5,727,374 | A * | 3/1998 | Fink | 57/58.86 |
| 6,272,829 | B1 * | 8/2001 | Kimura et al. | 57/100 |
| 6,425,236 | B1 | 7/2002 | Roquet et al. | 57/58.49 |

FOREIGN PATENT DOCUMENTS

| | | |
|---|---|---|
| DE | 30 12 427 A1 | 4/1981 |
| EP | 0 489 225 A1 | 6/1992 |
| EP | 1 101 847 A1 | 5/2001 |
| GB | 1 309 210 | 3/1973 |

* cited by examiner

*Primary Examiner*—Shaun R Hurley
(74) *Attorney, Agent, or Firm*—K & L Gates LLP

(57) ABSTRACT

A two-for-one twisting spindle comprising a pneumatically actuated threading device, a spindle bolt (2) that is rotatable about the vertical rotary shaft (33) thereof, and an injector (12) which extends into a thread guiding channel (14). The injector (12) can be temporarily connected to a compressed air source (15). The thread (35) is conveyed through the thread guiding channel (14) by means of an air flow during the threading process. The compressed air supply unit is provided with an annular chamber (9) which is mounted upstream of the injector (12) and is formed by a rigid annular flange (8) that extends around the spindle bolt (2) and is joined thereto in a fixed manner.

7 Claims, 2 Drawing Sheets

TWO-FOR-ONE TWISTING SPINDLE COMPRISING A PNEUMATICALLY ACTUATED THREADING DEVICE

CROSS-REFERENCE TO RELATED APPLICATIONS

This application claims the benefit of German patent application 10 2004 050 180.7, filed Oct. 14, 2004, herein incorporated by reference.

BACKGROUND OF THE INVENTION

The invention relates to a two-for-one twisting spindle comprising a pneumatically actuated threading device and, more particularly, to such a twisting spindle comprising a spindle bolt that is rotatable about its vertically arranged rotational axis, wherein an injector opens into a thread guiding channel, the injector can be temporarily connected to a compressed air source by a compressed air supply and the thread is conveyed through the thread guiding channel by means of an air flow during the threading process.

In the case of two-for-one twisting spindles, the thread is generally drawn off upwardly from the stationary supply bobbin, introduced into the upper end of a thread inlet tube, deflected downwardly and guided to the spindle rotor which it leaves through a thread guiding channel or a thread outlet channel in the radial direction.

After leaving the thread guiding channel, the thread is guided upwardly and in the process forms a balloon rotating about the supply bobbin. A thread guiding eyelet is used as a balloon limiter. The thread then runs via a thread traversing guide and is wound on a take-up bobbin.

On modern two-for-one twisting machines, the thread is threaded by means of compressed air and a threading injector. For the threading process, compressed air is supplied to the threading injector so a vacuum is produced which sucks the thread through the hollow shaft of the spindle, and so the thread is then conveyed radially outwardly by means of an air flow through the thread guiding channel.

The threading injector is arranged, for example, on the stationary part of the hollow shaft, and the air supply is supplied horizontally through the protection pot of the two-for-one twisting spindle, as disclosed in European Patent Publication EP 0 489 225 B1. In a further embodiment shown in the generic German Patent Publication DE 30 12 427 C2, the injector is a component of the rotating storage disc. The air is supplied through the hollow shaft of the spindle bolt.

These embodiments have the drawback that a relatively large number of components have to be sealed and adapted with respect to one another. Expensive processing steps of the components, for example to form the air channels are necessary, in particular, for the air guidance.

SUMMARY OF THE INVENTION

The object of the invention is to improve a two-for-one twisting spindle with a pneumatically actuated threading device of the type comprising a spindle bolt that is rotatable about its vertically arranged rotational axis, wherein an injector opens into a thread guiding channel, the injector can be temporarily connected to a compressed air source by a compressed air supply and the thread is conveyed through the thread guiding channel by means of an air flow during the threading process.

This object is achieved by means of a two-for-one twisting spindle wherein the compressed air supply has an annular chamber which is mounted upstream of the injector and which is formed at least by the spindle bolt and by a rigid annular flange which extends around the spindle bolt and is rigidly connected thereto.

Advantageous configurations of the invention are described more fully hereinbelow.

The two-for-one twisting spindle according to the invention is a compact design which saves space and weight. For production, no expensive and complicated processing operations are necessary. If the compressed air supply has an annular chamber which is mounted upstream from the injector and is formed by a rigid annular flange extending around the spindle bolt and rigidly connected thereto, the external diameter of the spindle bolt can be kept small and a strong and uniform injector effect can be achieved with the aid of the annular chamber. Even if it is completely possible in the scope of the invention to configure the annular flange in multiple parts, the number of parts to be fitted is kept small with a one-part annular flange. A U-shaped annular flange is simple to produce and stable. With an interference fit of the annular flange on the spindle bolt, a rigid connection is provided between the annular flange and spindle bolt and, at the same time, a good seal, which is not subject to wear, is achieved. Additional sealing elements are not required for the seal between the annular flange and spindle bolt.

An insertion element wherein the annular flange is arranged with an interference fit on the spindle bolt and the seal of the annular chamber between the spindle bolt and the annular flange is formed by the interference fit is simple and economical to produce. Plastics material can be selected as the material of the insertion element. Excellent wear protection can be achieved on the faces of the insertion element, which can wear owing to the running thread, by the use of ceramic elements.

With a configuration of the two-for-one twisting spindle wherein both a thread guiding element acting as the deflection point of the thread into the thread guiding channel and the injector mouth of the injector are arranged in an insertion element which can be introduced into the spindle bolt, a stationarily arranged compressed air supply to the spindle bolt is possible. The perpendicularly extending supply bore and the transverse bore form a T-shaped compressed air supply unit to the annular chamber. With this configuration, evened out maintenance of a high air pressure in the annular chamber and the injector mouth is ensured.

The hollow screw wherein the spindle bolt has in its lower part, a supply bore extending coaxially therein as a compressed air supply, with the bore opening into a horizontally arranged transverse bore, and in that the supply bore is connected to the annular chamber by means of the transverse bore, apart from air guidance, is simultaneously used for fastening the drive wharve. Additional fastening elements for the drive wharve are superfluous.

With this type of fastening by means of a hollow screw, it is easy and quick to carry out a change in the rotational speed by exchanging the fitted drive wharve for a drive wharve with a different external diameter.

The two-for-one twisting spindle is simple with regard to structure and fitting and can be produced economically. The injector produces an effective evened out air flow for threading the thread.

BRIEF DESCRIPTION OF THE DRAWINGS

An embodiment of the invention is described with the aid of the figures, in which.

DESCRIPTION OF THE PREFERRED EMBODIMENTS

Figure 1:
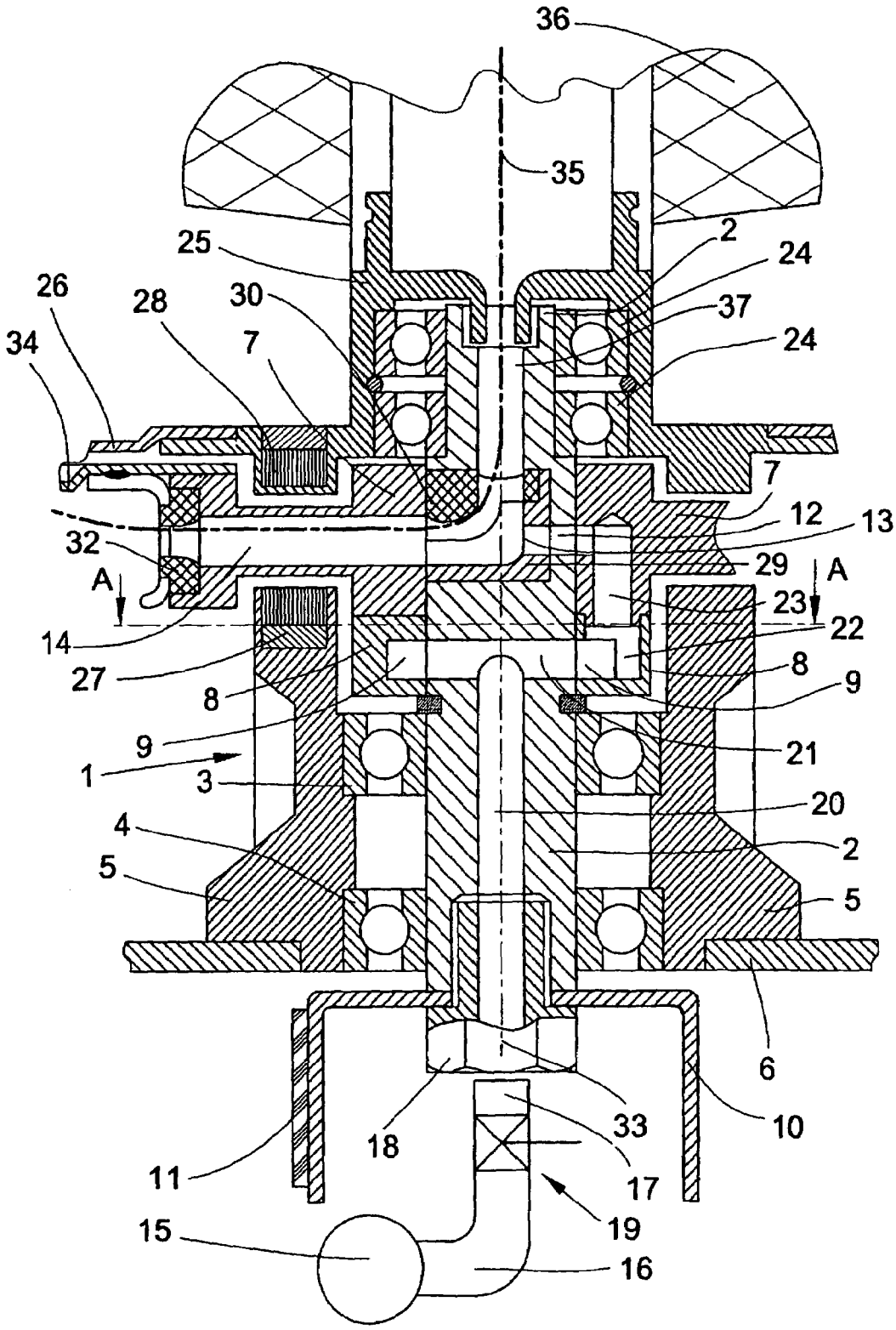
FIG. 1 shows a partial view of a two-for-one twisting spindle comprising a pneumatically actuated threading device in axial section.

FIG. 1 shows a two-for-one twisting spindle comprising a spindle bearing 1. The spindle bolt 2 is rotatably mounted in the bearing housing 5 by means of ball bearings 3, 4. The bearing housing 5 is fastened to the spindle rail 6. The spindle bolt 2 has a thread guiding ring 7, a U-shaped annular flange 8 with an annular chamber 9 and a drive wharve 10, which can be driven by means of a tangential belt 11. The spindle bolt 2 has an injector 12, the injector mouth 13 of which is directed onto the thread guiding channel 14. The injector 12 is temporarily connected to a compressed air source 15. The air flow in the compressed air line 16 can be interrupted by means of a shut-off device 19. The tube mouth 17 of the compressed air line 16 leading from the compressed air source 15 to the spindle bolt 2 is stationarily arranged underneath the spindle bolt 2. A stationary compressed air supply unit of this type is described in detail in DE 30 12 427 C2. The compressed air line 16 ends at a slight spacing from the head of a hollow screw 18. In this configuration, seals between the tube mouth 17 and the hollow screw 18 can be dispensed with. Compressed air losses are substantially avoided. The hollow screw 18 is fastened to the lower end of the spindle bolt 2 and guides the air flow to the supply bore 20 extending coaxially to the spindle bolt 2. The supply bore 20 opens in a transverse bore 21, which in turn ends in each case in the annular chamber 9. The injector 12 is connected via the flange bore 22 and the guide ring bore 23 to the annular chamber 9.

The upper part of the spindle bolt 2 retains the hollow hub 25 and the bobbin carrier base 26 by means of ball bearings 24. The bobbin carrier base 26 is rotatable relative to the spindle bolt 2 and is held, when the spindle bolt 2 rotates, in its position with respect to the bearing housing 5 or to the spindle rail 6 by magnetic force by the permanent magnets 27, 28.

Figure 2:
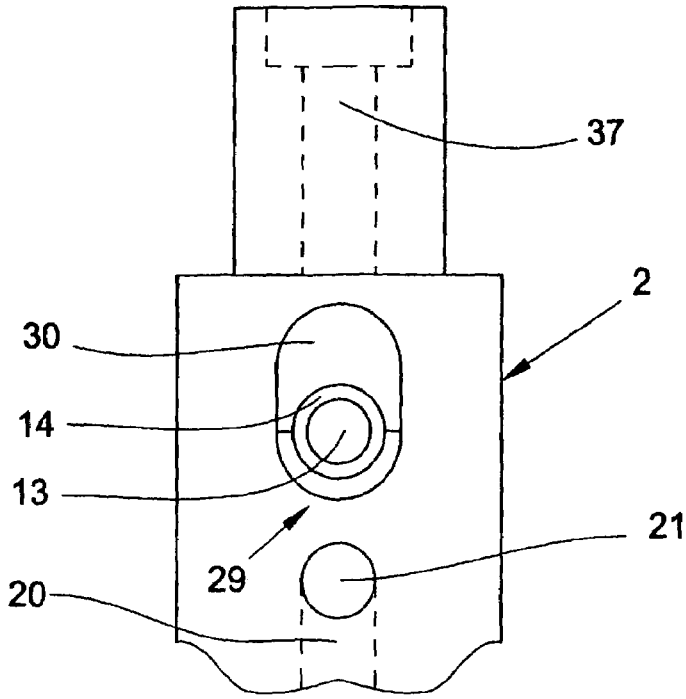
FIG. 2 shows a side view of a partially fitted spindle bolt of the two-for-one twisting spindle of FIG. 1 with an insertion element.

The spindle bolt 2 comprises an insertion element 29 made of plastics material with a thread guiding element 30 made of ceramics. The insertion element 29 has an oval shape, as shown in FIG. 2 and can be inserted into a corresponding recess of the spindle bolt 2. It can be produced economically and so as to fit precisely as an injection moulded part.

The U-shaped annular flange 8 is fastened with an interference fit on the spindle bolt 2. Owing to the interference fit, not only is a safe, stable connection provided between the annular flange 8 and spindle bolt 2, but also a good seal of the annular chamber 9.

Figure 3:
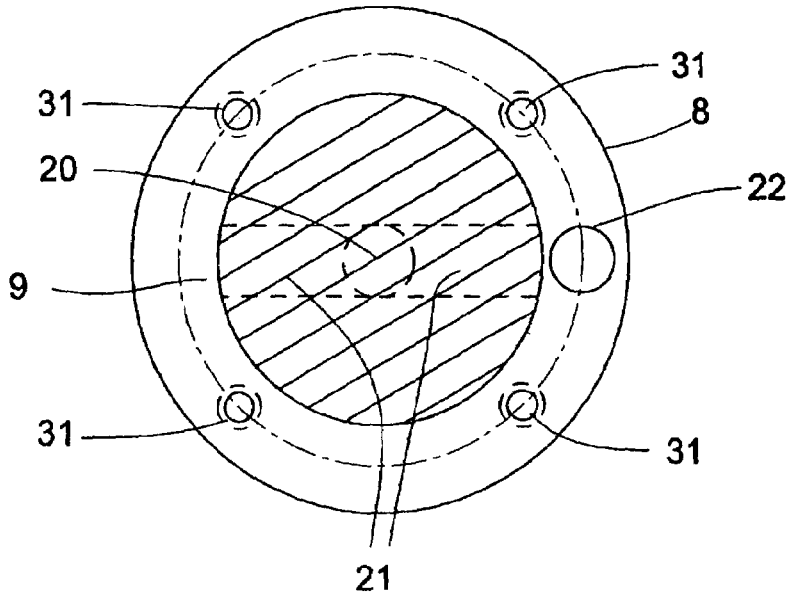
FIG. 3 shows a plan view of the annular flange connected to the spindle bolt and a section A-A through the spindle bolt.

The thread guiding ring 7 encloses the spindle bolt 2 at the lever of the insertion element 29 and rests on the annular flange 8, to which it is rigidly connected by screws not shown in the figures. The screws engage in threaded bores 31 in the annular flange 8. The position of the threaded bores 31 can be inferred from FIG. 3. Even if the threaded bores 31 are designed so as to be continuous into the annular chamber 9 with a small selected wall thickness of the annular flange 8, a good seal is ensured by the configuration of the threaded bores 31 with a fine thread.

The thread guiding channel 14 of the thread guiding ring 7 extending horizontally and therefore at right angles to the rotational axis 33 of the spindle bolt 2 has, at its outer end, a thread guiding ring 32 made of ceramics. The thread guiding ring 7 carries the rotary plate 34.

For threading, the thread 35 is drawn off upwardly from the stationary supply bobbin 36. The shut-off device 19 is opened and the compressed air flows through the hollow screw 18, the supply bore 20 and the transverse bore 21 into the annular chamber 9 and, from there, onward through the flange bore 22, the guiding ring bore 23 and the injector 12 up to the injector mouth 13. The annular chamber 9 acts as a compressed air store and a compressed air buffer is formed. A uniformly high air pressure is thereby achieved at the injector mouth 13 after the build up of pressure. The air blasted in by the injector 12 generates an air flow toward the exit of the thread guiding channel 14 and a vacuum in the thread inlet tube 37 of the spindle bolt 2. The thread 35 is sucked into the thread inlet tube 37 by the vacuum, deflected at the thread guiding element 30 and conveyed by the air flow through the thread guiding channel 14. At the thread guiding ring 32, the thread 35 is entrained and deflected by the air flowing upwardly there. After the threading process, the shut-off device 19 is activated and the connection between the compressed air source 15 and the spindle bolt 2 is interrupted again.

The invention claimed is:

1. Two-for-one twisting spindle comprising a pneumatically actuated threading device for a thread and comprising a spindle bolt that is rotatable about its vertically arranged rotational axis, wherein an injector opens into a thread guiding channel, the injector can be temporarily connected to a compressed air source by a compressed air supply and the thread is conveyed through the thread guiding channel by means of an air flow during the threading process, characterized in that the compressed air supply has an annular chamber (9) which is mounted upstream of the injector (12) and which is formed at least by the spindle bolt (2) and by a rigid annular flange (8) which extends around the spindle bolt (2) and is rigidly connected thereto.

2. Two-for-one twisting spindle according to claim 1, characterized in that the annular flange (8) is configured in one part.

3. Two-for-one twisting spindle according to claim 1, characterized in that the annular flange (8) is configured in a U-shape.

4. Two-for-one twisting spindle according to claim 1, characterized in that the annular flange (8) is arranged with an interference fit on the spindle bolt (2) and the seal of the annular chamber (9) between the spindle bolt (2) and the annular flange (8) is formed by the interference fit.

5. Two-for-one twisting spindle according to claim 1, characterized in that both a thread guiding element (30) acting as the deflection point of the thread (35) into the thread guiding channel (14) and the injector mouth (13) of the injector (12) are arranged in an insertion element (29) which can be introduced into the spindle bolt (2).

6. Two-for-one twisting spindle according to claim 1, characterized in that the spindle bolt (2) has in its lower part, a supply bore (20) extending coaxially therein as a compressed air supply, the bore opening into a horizontally arranged transverse bore (21), and in that the supply bore (20) is connected to the annular chamber (9) by means of the transverse bore (21).

7. Two-for-one twisting spindle according to claim 6, characterized Previously in that the supply bore (20) begins at the lower end of the spindle bolt (2) in a hollow screw (18) and the compressed air supply runs through the hollow screw (18) on the way from the compressed air source (15) to the injector (12), in that the spindle bolt (2) can be driven by means of a drive wharve (10) and the drive wharve (10) is connected by means of the hollow screw (18) so as to be rotationally engaged with the spindle bolt (2).

* * * * *